US009098022B2

(12) United States Patent
Liu et al.

(10) Patent No.: US 9,098,022 B2
(45) Date of Patent: Aug. 4, 2015

(54) METHOD AND APPARATUS FOR GENERATING DIFFERENTIAL GLOSS IMAGE USING LASER ENERGY

(75) Inventors: Chu-heng Liu, Penfield, NY (US); Timothy David Stowe, Alameda, CA (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 319 days.

(21) Appl. No.: 13/462,485

(22) Filed: May 2, 2012

(65) Prior Publication Data

US 2013/0294803 A1 Nov. 7, 2013

(51) Int. Cl.
*G03G 15/20* (2006.01)
*G03G 15/00* (2006.01)

(52) U.S. Cl.
CPC ..... *G03G 15/201* (2013.01); *G03G 15/205* (2013.01); *G03G 15/6585* (2013.01); *G03G 2215/00805* (2013.01)

(58) Field of Classification Search
CPC ..... G03G 15/6582; G03G 15/6585; G03G 2215/00805; G03G 2215/0081
USPC ..... 399/336, 341, 342; 430/124.13
See application file for complete search history.

(56) References Cited

U.S. PATENT DOCUMENTS

| | | | | |
|---|---|---|---|---|
| 4,503,437 | A | 3/1985 | Katzschner | |
| 5,184,152 | A | 2/1993 | French | |
| 5,220,356 | A | 6/1993 | Yaginuma | |
| 5,369,419 | A | 11/1994 | Stephenson et al. | |
| 5,519,426 | A | 5/1996 | Lukis et al. | |
| 6,066,829 | A | 5/2000 | Ishikawa | |
| 7,920,279 | B2 | 4/2011 | Ernst et al. | |
| 7,970,333 | B2 * | 6/2011 | Anderson et al. | 399/341 |
| 2002/0159785 | A1 | 10/2002 | Masuda et al. | |
| 2008/0101832 | A1 * | 5/2008 | Yaoi et al. | 399/336 |
| 2009/0245896 | A1 | 10/2009 | Ishikake et al. | |
| 2010/0055604 | A1 * | 3/2010 | Furuya | 430/124.13 |
| 2011/0058869 | A1 * | 3/2011 | Kagawa | 399/336 |
| 2011/0262196 | A1 | 10/2011 | Maeda | |
| 2012/0039643 | A1 | 2/2012 | Chang et al. | |
| 2014/0003849 | A1 * | 1/2014 | Liu | 399/341 |

FOREIGN PATENT DOCUMENTS

| | | | | |
|---|---|---|---|---|
| JP | 61-91678 | A | | 9/1986 |
| JP | 2008129061 | A | * | 6/2008 |
| JP | 2009058730 | A | * | 3/2009 |
| JP | 2011128223 | A | * | 6/2011 |
| JP | 2012083396 | A | * | 4/2012 |
| JP | 2012083673 | A | * | 4/2012 |

OTHER PUBLICATIONS

OTHER PUBLICATIONS

Chu-heng Liu, U.S. Appl. No. 13/539,416, Office Action dated Dec. 19, 2013.
Chu-heng Liu, U.S. Appl. No. 13/539,421, Office Action dated Aug. 2, 2013.
Chu-heng Liu, U.S. Appl. No. 13/539,421, Office Action dated Jan. 7, 2014.
Chu-heng Liu, U.S. Appl. No. 13/597,537, Office Action dated Nov. 5, 2013.

* cited by examiner

*Primary Examiner* — Robert Beatty
(74) *Attorney, Agent, or Firm* — Ronald E. Prass, Jr.; Prass LLP

(57) ABSTRACT

A method and system for enabling an image production device to generate differential gloss for a print includes exposing a toner image of a material to laser to cause one or more portions of the toner image to melt. The material includes the toner image and a substrate. The substrate is to remain substantially unaffected by the laser.

8 Claims, 7 Drawing Sheets

METHOD AND APPARATUS FOR GENERATING DIFFERENTIAL GLOSS IMAGE USING LASER ENERGY

BACKGROUND

Disclosed herein is a method and system for creating gloss images using differential gloss, as well as the corresponding computer-readable medium.

Gloss is an image or substrate attribute that describes how much specular reflection one get from a surface of a substrate. Specular reflection is the mirror-like reflection of light from a surface, in which light from a single incoming direction is reflected into a single outgoing direction. Because the surface of the substrate is not always perfectly flat, the light reflected from the surface of the substrate is not similar to what would generally be reflected from a mirror. When a surface of a substrate is rough, the percentage of the light that is reflected as specular reflection is less. In general, the rougher the surface, the lesser the chance of the reflected light is going to travel in the direction of the specular reflection. By varying the roughness of the surface, different types of finishes may be achieved.

One current technology that may be used to generate image-wise gloss effect is referred to as glossmark. Glossmark may involve paper, ink, halftones, and the manner of fusing the ink onto the paper. By adjusting the combination, the gloss can be modulated, creating a subtle image that may be viewed when the paper is held a certain way. The glossmark technology is described in US Patent Publication No. 20040001233 titled "Protecting printed items intended for public exchange with glossmarks" and US Patent Publication No. US20040156078 titled "Application of glossmarks for graphics enhancement". One disadvantage of the glossmark technology is that it can only be created at limited colors with small contrast. Another current technology that may affect a roughness of a surface is laser engraving. Laser engraving is the practice of engraving or marking an object by removing the materials from a solid surface using a high power laser. One of the disadvantages of laser engraving is that it requires very high energy: power density and energy density. Because of the high energy required, the speed of laser engraving is slow. Further, laser engraving generates fume and dust which is not environmental and user friendly. In addition, image resolution of laser engraving is very limited.

SUMMARY

A method and apparatus for implementing differential gloss using laser is disclosed. An ink image or a toner image may be exposed to laser from a laser imager. Melting of the inks or toners may occur based on heat generated by short pulse of laser applied to certain areas of the ink or toner image causing roughness characteristics. The roughness characteristics of the surface of the print may result in a differential gloss effect.

DETAILED DESCRIPTION

Aspects of the embodiments disclosed herein relate to a method generating differential gloss, as well as corresponding apparatus and computer-readable medium.

The disclosed embodiments may include a method for enabling an image production device to generate differential gloss for a print. The method includes exposing a toner image of a material to laser to cause one or more portions of the toner image to melt. The material includes the toner image and a substrate. The substrate is to remain substantially unaffected by the laser.

The disclosed embodiments may further include an image production device having a processor and a heating device coupled to the processor. The heating device may be configured to melt one or more portions of a toner image of a material. The material may include a substrate and the toner image. The substrate may remain substantially unaffected by the heating device. A surface of the one or more portions of the toner image is to be transformed between a flat state and a rough state based on operations of the heating device.

The disclosed embodiments may further include a computer-readable medium storing instructions for controlling an image production device to generate a print having differential gloss. The instructions may include configuring a heating device to use laser to cause a toner image of a material to melt based on pigments of the toner image absorbing the laser.

Figure 1A:
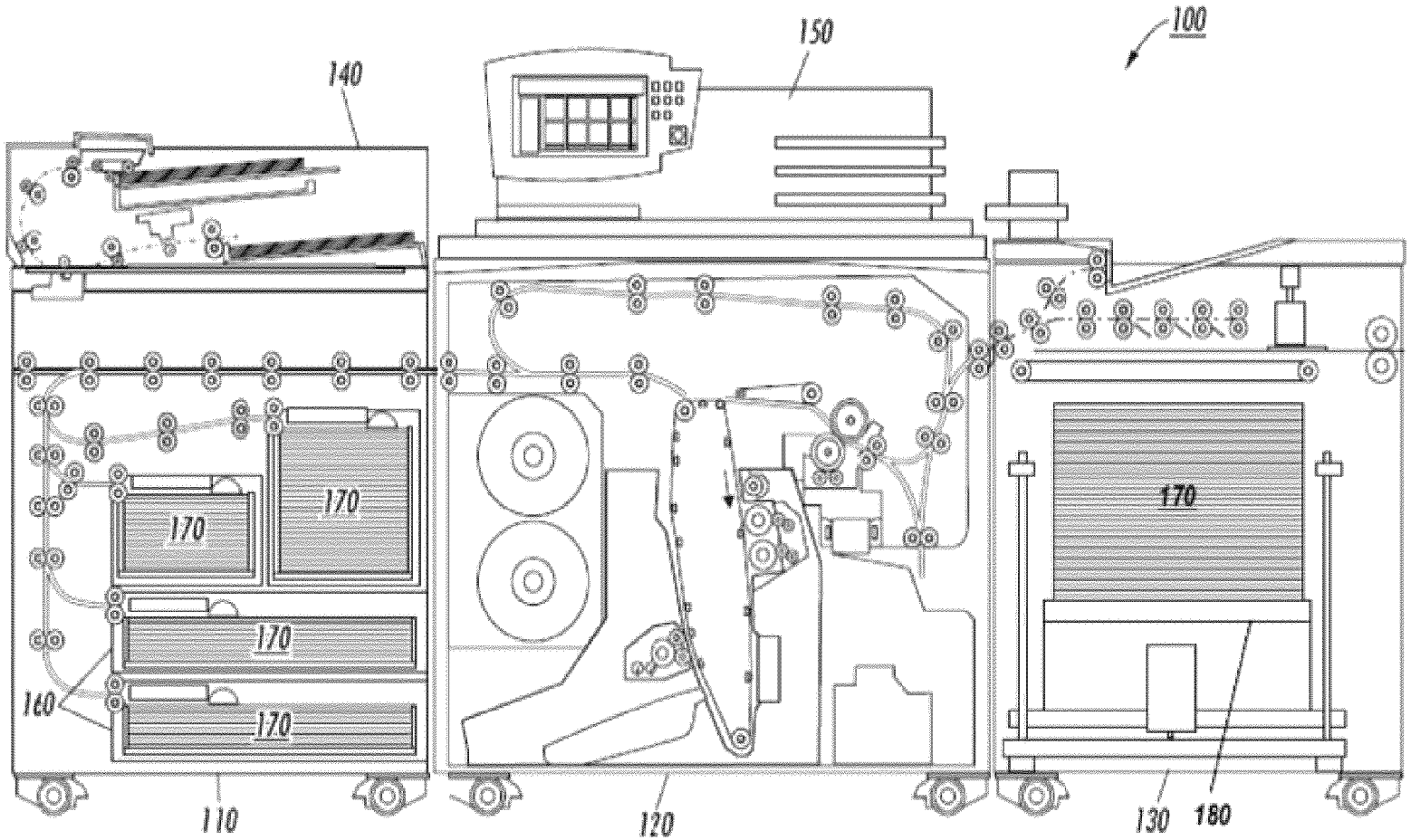
FIG. 1A is an exemplary diagram of an image production device in accordance with one possible embodiment of the disclosure.

FIG. 1A is an exemplary diagram of an image production device in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine.

If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more regular color or black and white images thereon.

Figure 1B:
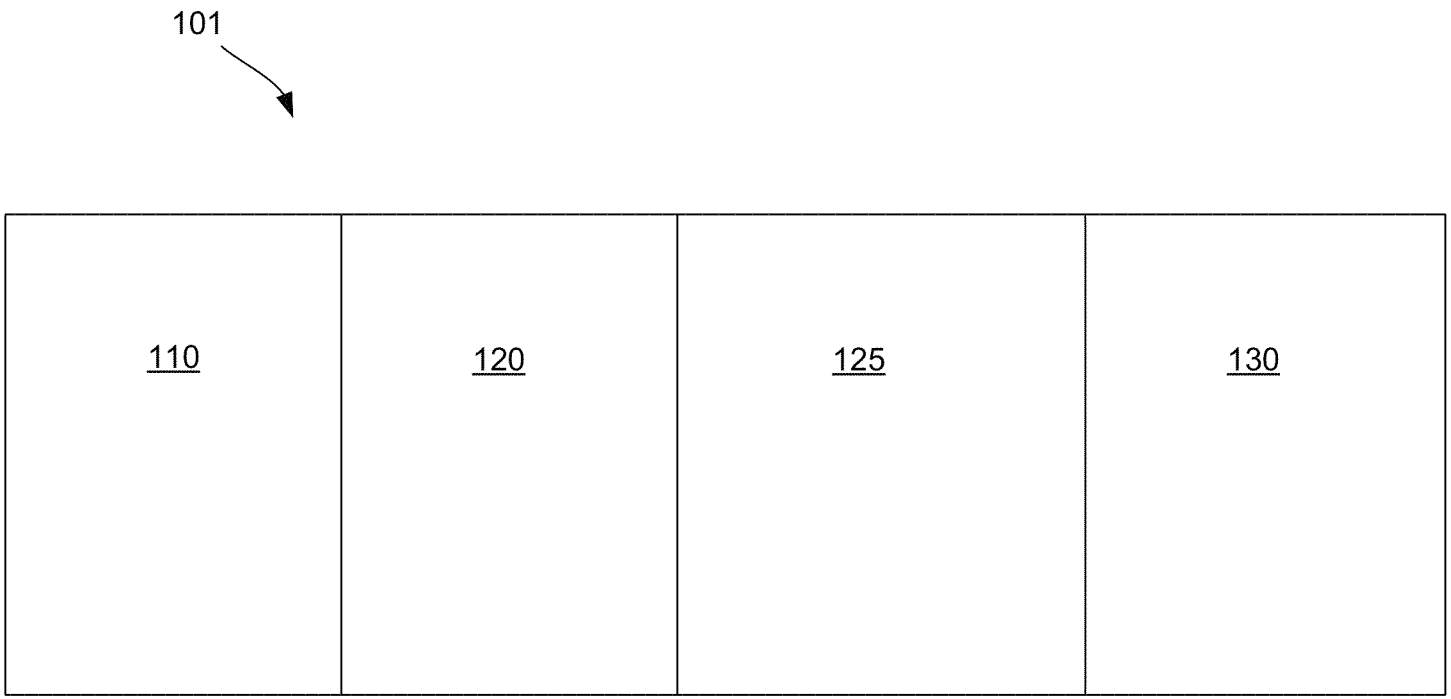
FIG. 1B is an exemplary diagram of an image production device configured with a gloss image section in accordance with one possible embodiment of the disclosure.

FIG. 1B is an exemplary block diagram of an image production device configured with a gloss image section, in accordance with one possible embodiment of the disclosure. The image production device 101 may be similar to the image production device 100 (shown in FIG. 1A) but is configured to include a gloss image creation section 125 (shown in this example as being between the image production section 120 and the output section 130). When a printed sheet is processed by the image production section 120, it may then be moved to the gloss image creation section 125. In accordance with one embodiment of the invention, a high power laser imager (shown in FIG. 2) may be used in the gloss image section 125 to act upon an image that has primarily contrast in color or density, to superimpose a secondary image with distinct contrast in gloss.

The printed sheet with both a primary color/density image and a secondary gloss image thereon may then be moved to output section 130, where it may be collated, stapled, folded, etc., with other media sheets in manners familiar in the art. The printed media may be place on a media stacker 180, for example.

Figure 2:
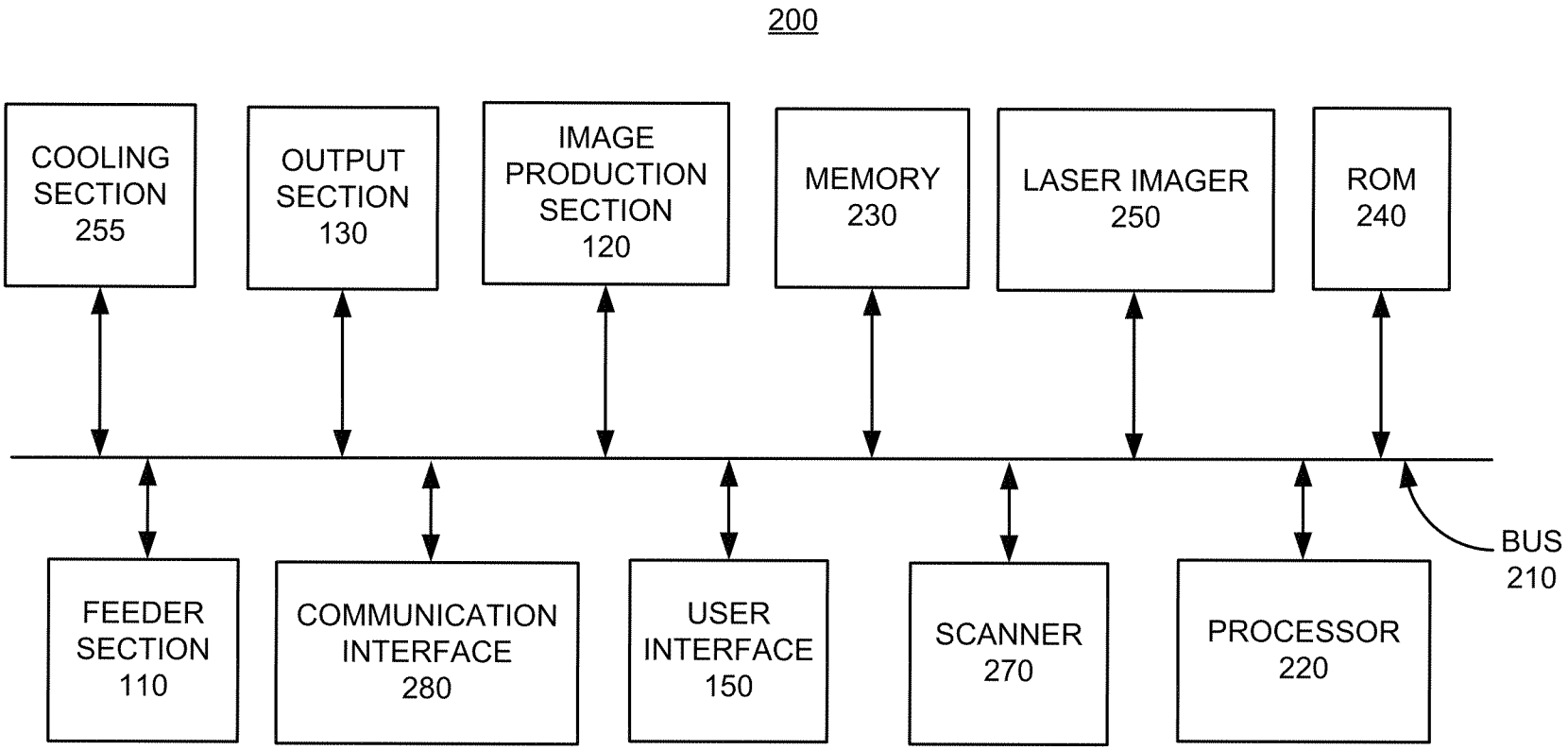
FIG. 2 is an exemplary block diagram of the image production device in accordance with one possible embodiment of the disclosure.

FIG. 2 is an exemplary block diagram of the processing logic of the image production device in accordance with one possible embodiment of the disclosure. Diagram 200 includes a bus 210, a processor 220, a memory 230, a read only memory (ROM) 240, a laser imager 250, a cooling section 255, a feeder section 110, an output section 130, a user interface 150, a communication interface 280, an image production section 120, and a scanner 270. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The laser imager 250 may include a high power laser source to provide sufficient laser energy to cause an ink or toner image of a material to melt. For this purpose, the laser imager 250 may serve as a heating device. For example, the laser imager 250 may be used to output the laser power in a certain pattern. This may cause different levels of roughness on the toner image, and therefore may affect a gloss appearance. Although the laser imager 250 is described herein as a separate module, it may be possible that the laser imager 250 may be implemented as part of another module or component of the image production device 100.

The cooling section 255 may be configured to cool the toner image after the one or more portions of the toner image begin to melt. Although the cooling section 255 is described herein as a separate module, it may be possible that the cooling section 255 may be implemented as part of another module or component of the image production device 100. For some embodiments, the cooling section 255 may be optional because the cooling may happen naturally as the heat diffuses away quickly from the local heating spot.

The scanner 270 (or image scanner) may be any scanner known to one of skill in the art, such as a flat-bed scanner, document feeder scanner, etc. The image scanner 270 may be a common full-rate half-rate carriage design and can be made with high resolution (600 dpi or greater) at low cost, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that performs particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Operation of the laser imager 250 will be discussed below in relation to FIGS. 3A, 3B and 4 and the process of using the laser imager 250 to generate a differential gloss effect by causing surface roughness will be discussed in relation to the flowchart in FIG. 6, for example.

Figure 3A:
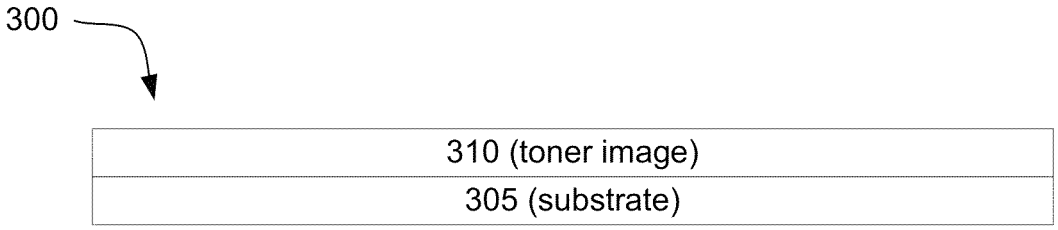
FIG. 3A is an exemplary diagram of a normal print surface in accordance with one possible embodiment of the disclosure.

FIG. 3A is an exemplary diagram of a material having a substrate with an ink or toner image in accordance with one possible embodiment of the disclosure. Material 300 may include a substrate 305 and a toner image 310. The toner image 310 (or a first layer) may be of any form. The substrate 305 (or second layer) may be flexible (e.g., paper, transparency, etc.) The toner image 310 may be a film of certain thickness (e.g., five microns) with some embedded pigments. The pigments may absorb the laser power and may reach a high temperature causing the toner image 310 to melt. The substrate 305 may serve as a heat sink that takes the heat away and cools down the toner image 310. The cooling of the material 300 may also be performed by the cooling section 255 (shown in FIG. 2).

Under regular condition, the toner image 310 may have uniform gloss. The toner image 310 is illustrated in this example as generally flat. For example, the material (or combination of the substrate 305 and the toner image 310) may be a print. In general, for photography or print applications, the common finishes desirable by the consumers are glossy finish and matte finish.

Figure 3B:
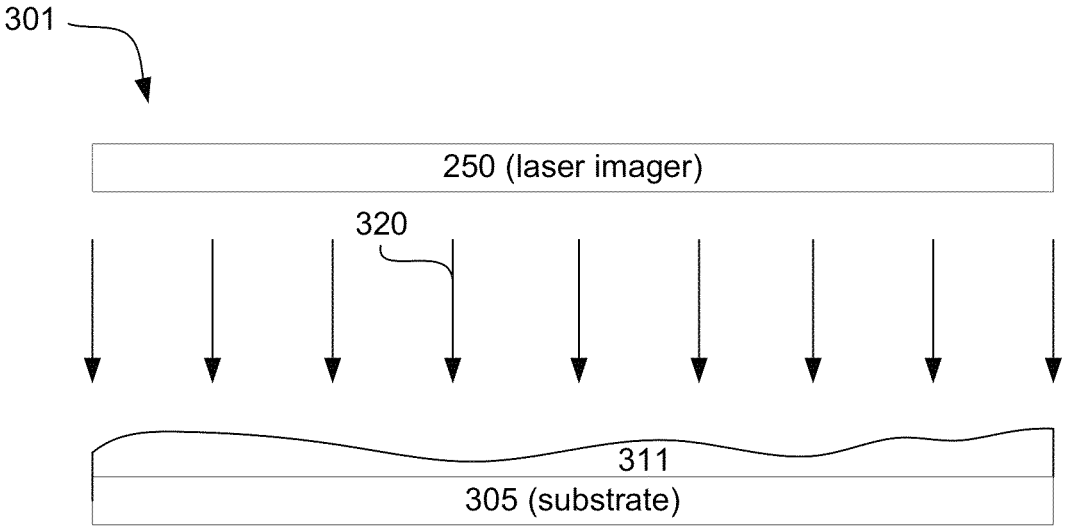
FIG. 3B is an exemplary diagram of a rough print surface due to melting of the inks or toners in accordance with one possible embodiment of the disclosure.

FIG. 3B is an exemplary diagram that illustrates one embodiment of generating differential gloss using a laser imager in accordance with one possible embodiment of the disclosure. In general, differential gloss refers to a glossy finish that may be achieved by providing a contrast of more glossy areas and less glossy areas. For example, surfaces with greater roughness will typically be less glossy. By modulating the surface roughness in an image-wise fashion, an image with distinct gloss contrast can be created.

For some embodiments, the laser imager 250 may be used to apply laser energy onto certain areas of the ink or toner image 310. The laser energy may be applied in short pulse and may be sufficiently high power to cause the ink or toner image to melt. This may cause the surface of the ink or toner image 310 of FIG. 3A to become rough. This is shown in the example as the ink or toner image 311 of FIG. 3B. For example, a black patch of a print may have a substantial uniform gloss. When the laser imager is applied to selected areas of the black patch, the ink of the areas that are exposed to the laser may become rough because of melting. The areas of the black patch that are not exposed to the laser may maintain the original gloss. As a result of applying the laser from the laser imager 250, there may be an image that can be seen as having differential gloss on top of the original printed image. The image on top of the original image may be independent of the underlying original image, and it may be adjusted by varying the laser pattern from the laser imager 250. It should be noticed that the substrate 305 may remain substantially the same with minimal or no impact caused by the laser from the laser imager 250.

For some embodiments, the laser imager may be applied using a combination of a beam and a x-y table. For some other embodiments, a line exposure of laser may be created in one direction while the substrate 305 may travel in a different direction such as, for example, a perpendicular direction.

For some embodiments, the power of the laser energy from the laser imager 250 may only be sufficient enough to cause melting of the toner image 310 but may not be too much more to avoid evaporation of ablation of the toner image 310 or the substrate 305. For example, the energy requirements may be ~1 kW/cm2 (100~10000 W/cm2) for power density, and ~1 J/cm2 (0.1~10 J/cm2) for energy density. This is different from the laser energy typically associated with laser ablation/engraving techniques where the laser energy is strong enough to be used in etching application of hard materials (e.g., stone, ceramic, etc.). For example, the typical laser energy requirements for laser ablation/engraving may be 1~100 MW/cm2 for power density, and 1~100 J/cm2 for energy density, where MW is Mega Watts. In addition, the laser ablation/engraving techniques may cause evaporation or removal of the material, whereas there is minimal or no evaporation or removal of the material caused by the embodiments of the present invention.

Figure 4A:
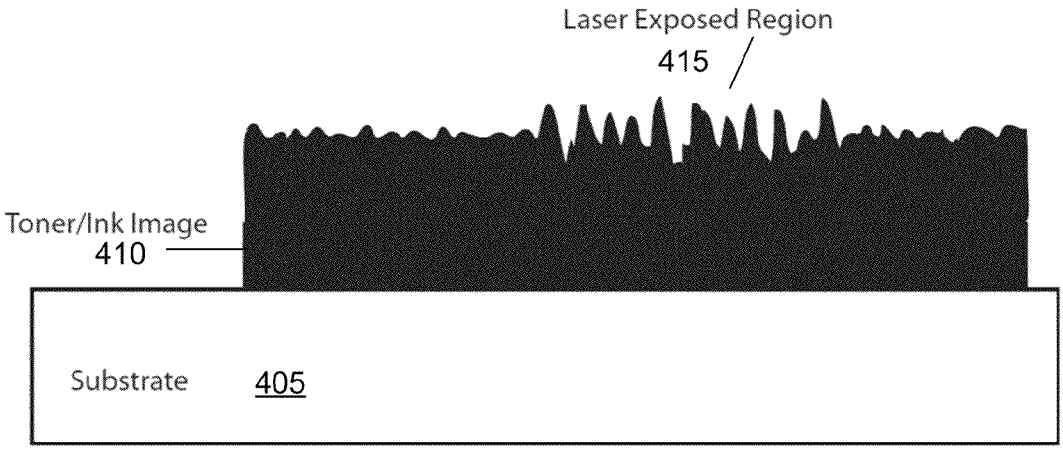
FIGS. 4A-4B includes exemplary diagrams that illustrate cross-section views of a toner image, in accordance with some embodiments.

FIG. 4A is an exemplary diagram that illustrates one cross-section view of a toner image, in accordance with some embodiments. The toner image 410 may be associated with the substrate 405 and may include a region 415 that has been exposed to the laser using some of the laser glossing techniques described herein. As can be noted, the surface of the region 415 may be rougher after being exposed to the laser, whereas the same surface may be less rough prior to being exposed to the laser.

Figure 4B:
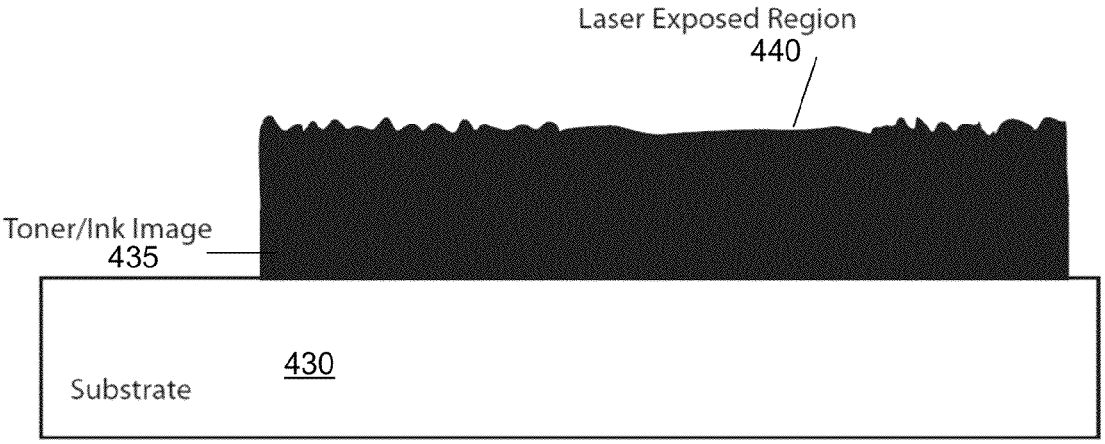

FIG. 4B is an exemplary diagram that illustrates another cross-section view of a toner image, in accordance with some embodiments. The toner image 435 may be associated with the substrate 430 and may include a region 440 that has been exposed to the laser using some of the laser glossing techniques described herein. As can be noted, the surface of the region 440 may be less rough after being exposed to the laser, whereas the same surface may be rougher prior to being exposed to the laser.

Figure 5:
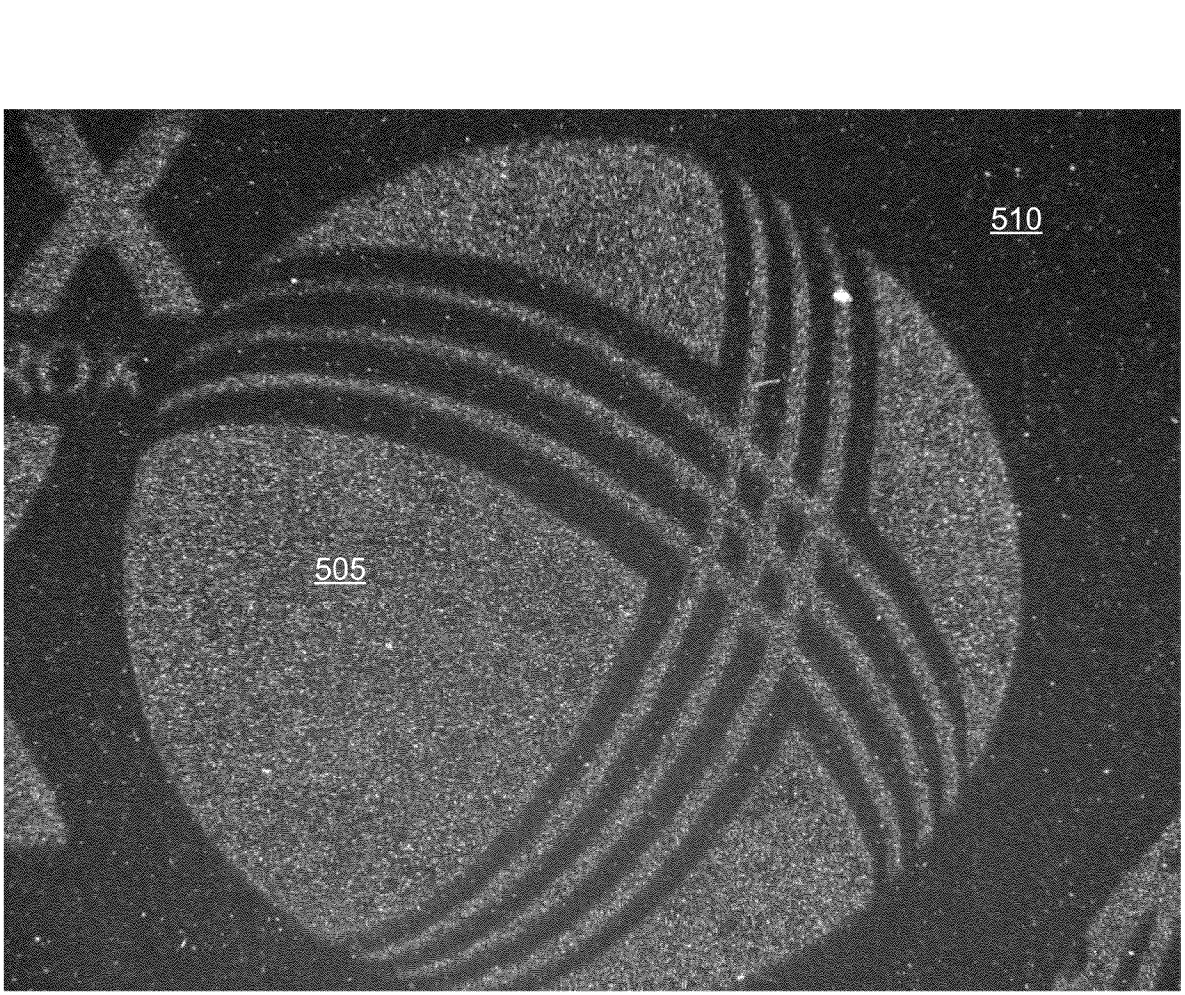
FIG. 5 is an exemplary image that illustrates one application of the laser glossing technique on a black toner image, in accordance with some embodiments.

FIG. 5 is an exemplary image that illustrates one application of the laser glossing technique on a black toner image, in accordance with some embodiments. Regions 505 and 510 may be part of a toner image 500. The region 505 may represent a region that has been exposed to the laser. The region 510 may represent a region that has not been exposed to the laser. In this example, the region 505 can be seen as a region with much lower gloss since it is significantly rougher.

Figure 6:
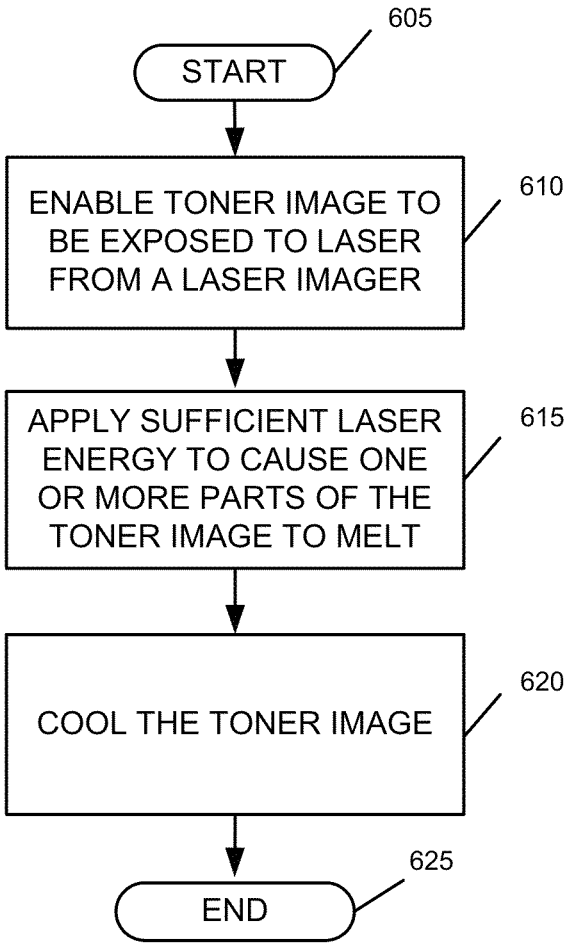
FIG. 6 is a flowchart of a differential gloss generation process in accordance with one possible embodiment of the disclosure.

FIG. 6 is a flowchart of a differential gloss generation process in accordance with one possible embodiment of the disclosure. The process may begin at block 605. The process may be applied with a material which may include a substrate and a toner image. For example, when the material is coming out of the image production system 120 (see FIGS. 1A and 1B and as used in electrostatic printing), the toner image of the material may become smooth. This may be because of the high temperature (e.g., about 200 degrees F.) characteristic and the high pressure characteristic of the fuser. The toner image may conform to the surface that it comes into contact with giving the toner image a smooth characteristic.

At block 610, the toner image of the material may be exposed to the laser from the laser imager 250 (see FIG. 2). At block 615, the laser energy from the laser may be sufficiently strong enough to heat and cause the one or more part of the toner image to melt. As mentioned above, the laser energy may not be as strong as the laser energy used in laser ablation/engraving. The material may not be homogeneous, so there may be some internal stress. As the material is heated, the internal stress may be relaxed causing some surface roughness. It may be possible for the reverse to occur where, because there may be some surface roughness, the heating may cause it to be smooth by the action of surface tension. It may be noted that the heating may be non-uniform and may be dependent on where the absorbing element is located. This is because certain pigment may be more absorbent than others based on the type of laser. For example, with near infrared (IR) laser, the black pigments absorb the best and show the effect of the melting the most. When the laser is changed to different level of energy (e.g., blue laser), then the red pigments may absorb the most and more roughness may occur in areas where there are more red pigments.

At block 620, the material may be cooled down. This may be an optional step as the cooling may happen naturally as the heat diffuses away quickly from the local heating spot. The transition from solid to liquid (heating and melting) and from liquid to solid (cooling) may be very quick. Using this process, it may be possible to superimpose another image (e.g., one with the rough surface) on top of the regular color image (e.g., the original image). The process may then go to block 625 and ends. The process described in FIG. 6 may be useful in applications that enhance glossy graphics effect providing more attractive, high end perception of the material. The process may also be used to generate security features on prints to make it difficult to duplicate, among other applications.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image forming method, comprising:

forming a toner image on an image receiving media substrate by depositing a toner material on the image receiving media substrate in an image forming device;

superimposing a secondary image on the toner image formed on the image receiving media substrate, the secondary image (1) being independent of the toner image underlying the secondary image and (2) having a first surface roughness; and exposing portions of the secondary image to short pulses of laser energy from a single source of laser energy in the image forming device, the laser energy modifying the first surface roughness of the exposed portions of the secondary image to a second surface roughness while the toner image and the image receiving media substrate remain substantially unaffected by the laser energy, a difference in surface roughness between the first surface roughness and the second surface roughness causing a distinct contrast in gloss in the secondary image, and the laser energy being applied in a manner that precludes losses in the toner material and evaporation of the toner material in the toner image.

2. The method of claim 1, wherein the image receiving media substrate is flexible.

3. The method of claim 1, the single source of laser energy being a laser associated with a laser imager in the image forming device.

4. An image production device, comprising:

a marking unit that deposits toner material on an image receiving media substrate to form a toner image on the image receiving media substrate; and a gloss image unit, positioned downstream of the marking unit in a process direction, that superimposes a secondary image on the toner image formed on the image receiving media substrate, the secondary image (1) being independent of the toner image underlying the secondary image and (2) having a first surface roughness, the gloss image unit including a laser imager including a single laser source coupled to and controlled by a processor, the laser imager being configured to generate short pulsed laser energy directed at portions of the secondary image to modify the exposed portions of the secondary image to a second surface roughness while the toner image and the image receiving media substrate remain substantially unaffected by the laser energy, a difference in surface roughness between the first surface roughness and the second surface roughness causing a distinct contrast in gloss in the secondary image, and the laser energy being applied in a manner that precludes losses in the toner material and evaporation of the toner material in the toner image.

5. The image production device of claim 4, wherein the image receiving media substrate is flexible.

6. A non-transitory computer-readable medium storing instructions for controlling a computing device, the instructions, when executed by the computing device, cause the computing device to control a method for image forming in an image production device, the method comprising:

forming a toner image on an image receiving media substrate by depositing a toner material on the image receiving media substrate in the image production device;

superimposing a secondary image on the toner image formed on the image receiving media substrate, the secondary image (1) being independent of the toner image underlying the secondary image and (2) having a first surface roughness; and exposing portions of the secondary image to short pulses of laser energy from a single laser energy source, the laser energy modifying the first surface roughness of the exposed portions of the secondary image to a second surface roughness while the toner image and the image receiving media substrate remain substantially unaffected by the laser energy, a difference in surface roughness between the first surface roughness and the second surface roughness causing a distinct contrast in gloss in the secondary image, and the laser energy being applied in a manner that precludes losses in the toner material and evaporation of the toner material in the toner image.

7. The non-transitory computer-readable medium of claim 6, the single laser energy source being a laser imager.

8. The non-transitory computer-readable medium of claim 6, wherein the image receiving media substrate is a flexible substrate.

* * * * *